US010006109B2

(12) United States Patent
Nakanishi et al.

(10) Patent No.: US 10,006,109 B2
(45) Date of Patent: Jun. 26, 2018

(54) NON-ORIENTED ELECTRICAL STEEL SHEET AND HOT ROLLED STEEL SHEET THEREOF

(71) Applicant: JFE STEEL CORPORATION, Tokyo (JP)

(72) Inventors: Tadashi Nakanishi, Kurashiki (JP); Shinji Koseki, Kawasaki (JP); Yoshihiko Oda, Fukuyama (JP); Hiroaki Toda, Suginamiku (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days. days.

(21) Appl. No.: 14/909,940

(22) PCT Filed: Aug. 11, 2014

(86) PCT No.: PCT/JP2014/071176

§ 371 (c)(1),
(2) Date: Feb. 3, 2016

(87) PCT Pub. No.: WO2015/025758

PCT Pub. Date: Feb. 26, 2015

(65) Prior Publication Data

US 2016/0203895 A1 Jul. 14, 2016

(30) Foreign Application Priority Data

Aug. 20, 2013 (JP) ..... 2013-170160

(51) Int. Cl.

| | |
|---|---|
| ***H01F 1/16*** | (2006.01) |
| ***C22C 38/06*** | (2006.01) |
| ***B21B 3/02*** | (2006.01) |
| ***C22C 38/02*** | (2006.01) |
| ***C22C 38/00*** | (2006.01) |
| ***H01F 1/34*** | (2006.01) |
| ***C22C 38/60*** | (2006.01) |
| ***C22C 38/04*** | (2006.01) |
| ***C21D 8/12*** | (2006.01) |
| *C21C 7/04* | (2006.01) |

(52) U.S. Cl.

CPC ..... *C22C 38/00* (2013.01); *C21D 8/12* (2013.01); *C21D 8/1233* (2013.01); *C21D 8/1272* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/16* (2013.01); *H01F 1/342* (2013.01); *B21B 3/02* (2013.01); *C21C 7/04* (2013.01); *C21D 2211/004* (2013.01)

(58) Field of Classification Search

CPC H01F 1/16; B21B 3/02; C22C 38/001; C22C 38/002; C22C 38/004; C22C 38/008; C22C 38/02; C22C 38/04; C22C 38/06; C22C 38/60

See application file for complete search history.

(56) References Cited

U.S. PATENT DOCUMENTS

| | | | | |
|---|---|---|---|---|
| 2004/0149355 | A1 | 8/2004 | Kohno et al. | |
| 2006/0243351 | A1 | 11/2006 | Ohashi et al. | |
| 2006/0266448 | A1* | 11/2006 | Arai | C21D 1/18 148/593 |
| 2008/0112838 | A1 | 5/2008 | Miyazaki et al. | |
| 2009/0202383 | A1* | 8/2009 | Tanaka | C22C 38/004 420/83 |
| 2009/0250145 | A1 | 10/2009 | Kurosaki et al. | |
| 2015/0059929 | A1 | 3/2015 | Zaizen et al. | |

FOREIGN PATENT DOCUMENTS

| | | | |
|---|---|---|---|
| CN | 101218362 | A | 7/2008 |
| CN | 101812629 | A | 8/2010 |
| CN | 102796947 | A | 11/2012 |
| JP | H03-229820 | A | 10/1991 |
| JP | H06-73511 | A | 3/1994 |
| JP | H06-80169 | B2 | 10/1994 |
| JP | H08-60311 | A | 3/1996 |
| JP | 2500033 | B2 | 5/1996 |

(Continued)

OTHER PUBLICATIONS

Nov. 11, 2014 Search Report issued in International Patent Application No. PCT/JP2014/071176.
Aug. 7, 2015 Office Action issued in Taiwanese Patent Application No. 103128444.
Jun. 6, 2016 Extended European Search Report issued in European Patent Application No. 14837315.2.
Jun. 7, 2016 Office Action issued in Korean Patent Application No. 2016-7003107.
Feb. 7, 2017 Office Action issued in Russian Patent Application No. 2016105849.
Apr. 4, 2017 Office Action issued in U.S. Appl. No. 15/111,310.
U.S. Appl. No. 15/111,310, filed Jul. 13, 2016 in the name of Oda et al.
U.S. Appl. No. 14/909,978, filed Feb. 3, 2016 in the name of Nakanishi et al.
Apr. 4, 2017 Office Action issued in U.S. Appl. No. 14/909,978.
Oct. 27, 2017 Office Action issued in U.S. Appl. No. 15/111,310.
Mar. 9, 2018 Office Action issued in U.S. Appl. No. 15/503,508.
Mar. 8, 2018 Office Action issued in U.S. Appl. No. 15/111,310.

*Primary Examiner* — Jenny R Wu
(74) *Attorney, Agent, or Firm* — Oliff PLC

(57) ABSTRACT

A non-oriented electrical steel sheet having a high magnetic flux density and a low iron loss at not only a commercial frequency but also a high frequency zone, which has a chemical composition including C: not more than 0.0050 mass %, Si: more than 1.5 mass % but not more than 5.0 mass %, Mn: not more than 0.10 mass %, sol. Al: not more than 0.0050 mass, P: more than 0.040 mass % but not more than 0.2 mass %, S: not more than 0.0050 mass %, N: not more than 0.0040 mass % and Ca: 0.001-0.01 mass % and the remainder being Fe and inevitable impurities and a compositional ratio of CaO in oxide-based inclusions existing in a steel sheet of not less than 0.4 and/or a compositional ratio of $Al_2O_3$ of not less than 0.3, and a hot rolled steel sheet used as a raw steel material thereof.

4 Claims, 1 Drawing Sheet

(56) References Cited

FOREIGN PATENT DOCUMENTS

| | | | | |
|---|---|---|---|---|
| JP | 2000-129410 | A | | 5/2000 |
| JP | 2001-158949 | A | | 6/2001 |
| JP | 2001158949 | | * | 6/2001 |
| JP | 2001-192788 | A | | 7/2001 |
| JP | 2001-323344 | A | | 11/2001 |
| JP | 2001-323345 | A | | 11/2001 |
| JP | 3378934 | B2 | | 2/2003 |
| JP | 2004-149823 | A | | 5/2004 |
| JP | 2004-292829 | A | | 10/2004 |
| JP | 2005-200756 | A | | 7/2005 |
| JP | 2006-104530 | A | | 4/2006 |
| JP | 3870893 | B2 | | 1/2007 |
| JP | 4126479 | B2 | | 7/2008 |
| JP | 2008-231504 | A | | 10/2008 |
| JP | 2010-248559 | A | | 11/2010 |
| JP | 2012-036454 | A | | 2/2012 |
| JP | 2012136763 | A | | 7/2012 |
| JP | 2012136764 | A | | 7/2012 |
| JP | 2012140676 | A | | 7/2012 |
| JP | 2012-149337 | A | | 8/2012 |
| JP | 2013-082973 | A | | 5/2013 |
| JP | 2013-189693 | A | | 9/2013 |
| KR | 2002-0018226 | A | | 3/2002 |
| KR | 20020018226 | A | * | 3/2002 |
| KR | 20050060869 | A | * | 6/2005 |
| RU | 2 311 479 | C2 | | 11/2007 |
| RU | 2 362 829 | C2 | | 7/2009 |
| RU | 2 398 894 | C1 | | 9/2010 |
| RU | 2 400 325 | C1 | | 9/2010 |
| TW | 201329244 | A | | 7/2013 |
| WO | 2013/080891 | A1 | | 6/2013 |

* cited by examiner

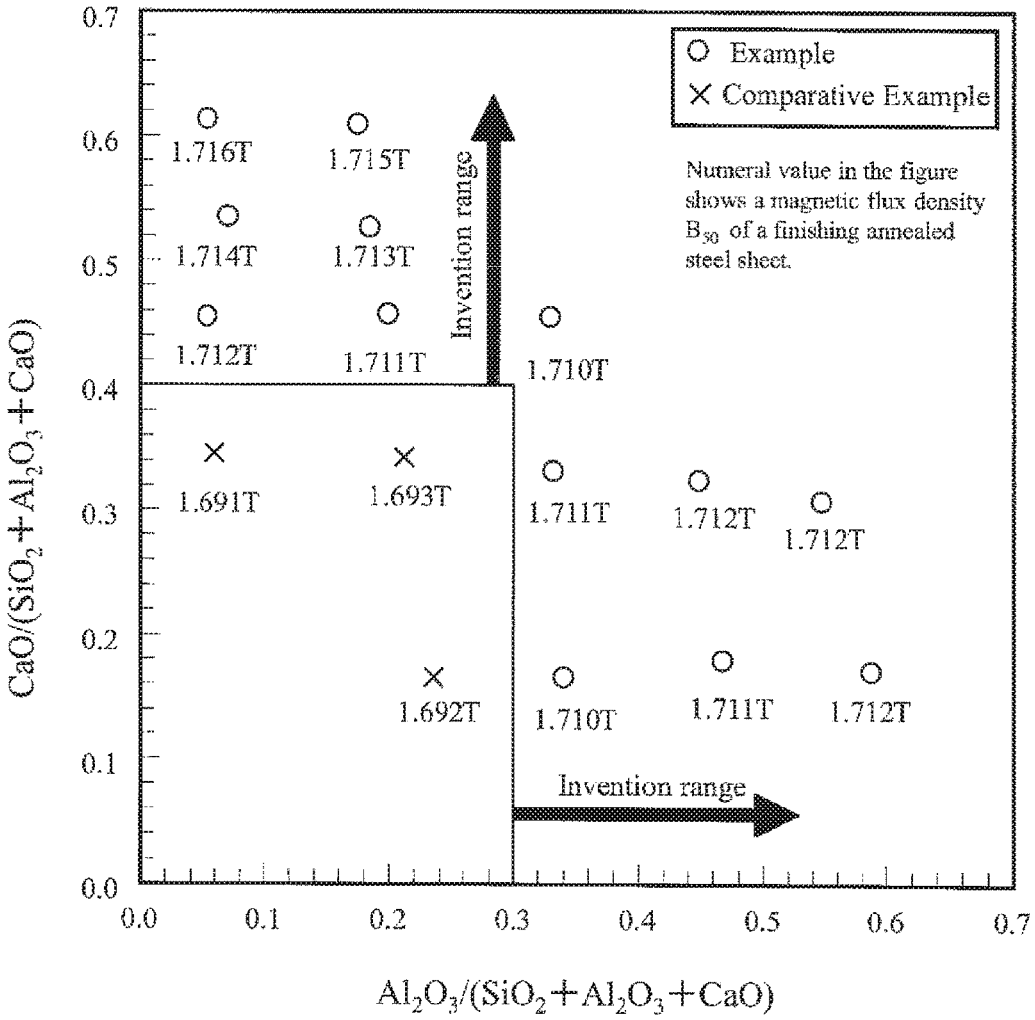
Example
Comparative Example
Numeral value in the figure shows a magnetic flux density $B_{50}$ of a finishing annealed steel sheet.
1.716T
1.715T
1.714T
1.713T
1.712T
1.711T
1.710T
1.691T
1.693T
1.711T
1.712T
1.712T
1.692T
1.710T
1.711T
1.712T
Invention range
Invention range
$CaO/(SiO_2+Al_2O_3+CaO)$
$Al_2O_3/(SiO_2+Al_2O_3+CaO)$
0.0
0.1
0.2
0.3
0.4
0.5
0.6
0.7

NON-ORIENTED ELECTRICAL STEEL SHEET AND HOT ROLLED STEEL SHEET THEREOF

TECHNICAL FIELD

This invention relates to a non-oriented electrical steel sheet used as an iron core for a driving motor of electric vehicle and hybrid vehicle, a motor of power generator or the like and having a high magnetic flux density and a low iron loss, and a hot rolled steel sheet used as a raw material therefor.

RELATED ART

Recently, hybrid vehicles and electric vehicles are rapidly put into practical use. In a driving motor of these vehicles or a motor of a power generator, it is made possible to control a driving power source by a frequency with the advance of a driving system, so that motors driving at a variable speed or rotating at a high speed in a frequency zone higher than a commercial frequency are increasing for downsizing such a motor. As a result, non-oriented electrical steel sheets used in an iron core of such a motor are strongly demanded to have a high magnetic flux density and a low iron loss at a high frequency zone from a viewpoint of a high efficiency and a high power.

As a method of reducing an iron loss in the non-oriented electrical steel sheet was usually used a method of reducing an eddy current loss by increasing an addition amount of an element increasing specific resistance such as Si, Al, Mn or the like. However, this method has a problem that the lowering of the magnetic flux density is inescapable.

To this end, there are proposed some techniques for increasing the magnetic flux density of the non-oriented electrical steel sheet. For example, Patent Document 1 proposes a technique wherein a magnetic flux density in a raw steel material comprising C: not more than 0.005 mass %, Si: 0.1-1.0 mass % and sol. Al: less than 0.002 mass % is increased by adding P within a range of 0.05-0.200 mass % and decreasing Mn to not more than 0.20 mass %. However, when this technique is applied to an actual production, there are problems that troubles such as sheet breakage and the like are frequently caused in a rolling step or the like and it is obliged to stop the production line or lower the yield. Since Si content is as low as 0.1-1.0 mass %, there is a problem that an iron loss, particularly iron loss at a high frequency zone is high.

Also, Patent Document 2 proposes a technique wherein a high magnetic flux density is attained by controlling Al content to not more than 0.017 mass % in a raw steel material comprising Si: 1.5-4.0 mass % and Mn: 0.005-11.5 mass %. In this technique, however, a single rolling at room temperature is adopted as a cold rolling, so that an effect of sufficiently increasing the magnetic flux density cannot be obtained. If two or more cold rollings including an intermediate annealing is used as the cold rolling, the increase of the magnetic flux density can be attained, but there is a problem that the production cost is increased. If the cold rolling is a warm rolling at a sheet temperature of about 200° C., it is effective to increase the magnetic flux density, but there is a problem that it is necessary to use an equipment for such an object and perform process control thereof.

In addition to the above method of decreasing Mn or Al content or adding P, Patent Document 3 discloses that Sb or Sn may be added to a slab comprising by wt % C: not more than 0.02%, Si or Si+Al: not more than 4.0%, Mn: not more than 1.0% and P: not more than 0.2% for the purpose of increasing the magnetic flux density.

Furthermore, Patent Document 4 proposes a technique wherein a compositional ratio of an oxide-based inclusion in a hot rolled steel sheet comprising by wt % C≤0.008%, Si≤4%, Al≤2.5%, Mn≤1.5%, P≤0.2%, S≤0.005% and N≤0.003% is controlled to $MnO/(SiO_2+Al_2O_3+CaO+MnO)$ ≤0.35 to thereby decrease the number of inclusions extended in the rolling direction and improve crystal grain growth. However, this technique has a problem that if Mn content is low, magnetic properties, particularly iron loss properties are deteriorated due to precipitation of a sulfide such as fine MnS or the like.

PRIOR ART DOCUMENTS

Patent Documents

Patent Document 1: JP-B-H06-080169
Patent Document 2: Japanese Patent No. 4126479
Patent Document 3: Japanese Patent No. 2500033
Patent Document 4: Japanese Patent No. 3378934

SUMMARY OF THE INVENTION

Task to be Solved by the Invention

In the above conventional techniques, however, it is an actual condition that a non-oriented electrical steel sheet having a high magnetic flux density and a low iron loss at a high frequency zone is difficult to be produced in a low cost and a good productivity without requiring new equipment or process control in a region that Si content being sufficiently low in the eddy current loss exceeds 3.0 mass %.

The invention is made in view of the above problems inherent to the conventional techniques and is to provide a non-oriented electrical steel sheet having a high magnetic flux density and a low iron loss at not only a commercial frequency but also a high frequency zone and a hot rolled steel sheet used as a raw material therefor.

Solution for Task

The inventors have focused attention on oxide-based inclusions existing in a steel sheet for solving the above problems and made various studies. As a result, it has been found out that in order to increase a magnetic flux density of a non-oriented electrical steel sheet, it is effective to control a compositional ratio of an oxide-based inclusion existing in a hot rolled steel sheet and a product sheet to a specified range by decreasing Mn and sol. Al contents as far as possible and adding Ca, and hence the invention has been accomplished.

That is, the invention is a non-oriented electrical steel sheet having a chemical composition comprising C: not more than 0.0050 mass %, Si: more than 1.5 mass % but not more than 5.0 mass %, Mn: not more than 0.10 mass %, sol. Al: not more than 0.0050 mass %, P: more than 0.040 mass % but not more than 0.2 mass %, S: not more than 0.0050 mass %, N: not more than 0.0040 mass %, Ca: 0.001-0.01 mass % and the remainder being Fe and inevitable impurities, in which a compositional ratio of CaO in oxide-based inclusions existing in a steel sheet defined by the following equation (1):

$$CaO/(SiO_2+Al_2O_3+CaO) \quad (1)$$

is not less than 0.4 and/or a compositional ratio of $Al_2O_3$ defined by the following equation (2):

$$Al_2O_3/(SiO_2+Al_2O_3+CaO) \quad (2)$$

is not less than 0.3.

The non-oriented electrical steel sheet according to the invention is characterized by including 0.01-0.1 mass % for each of one or two selected from Sn and Sb in addition to the above chemical composition.

Also, the invention is a hot rolled steel sheet used as a raw material for a non-oriented electrical steel sheet having a chemical composition comprising C: not more than 0.0050 mass %, Si: more than 1.5 mass % but not more than 5.0 mass %, Mn: not more than 0.10 mass %, sol. Al: not more than 0.0050 mass %, P: more than 0.040 mass % but not more than 0.2 mass %, S: not more than 0.0050 mass %, N: not more than 0.0040 mass %, Ca: 0.001-0.01 mass % and the remainder being Fe and inevitable impurities, in which a compositional ratio of CaO in oxide-based inclusions existing in a steel sheet defined by the following equation (1):

$$CaO/(SiO_2+Al_2O_3+CaO) \quad (1)$$

is not less than 0.4 and/or a compositional ratio of $Al_2O_3$ defined by the following equation (2):

$$Al_2O_3/(SiO_2+Al_2O_3+CaO) \quad (2)$$

is not less than 0.3.

The hot rolled steel sheet according to the invention is characterized by including 0.01-0.1 mass % for each of one or two selected from Sn and Sb in addition to the above chemical composition.

Effect of the Invention

According to the invention, non-oriented electrical steel sheets having a high magnetic flux density and a low iron loss at not only a commercial frequency but also a high frequency zone can be provided in a low cost and a good productivity without requiring a new equipment and a process control. Therefore, the non-oriented electrical steel sheet according to the invention can be preferably used as an iron core material for a driving motor of electric vehicles and hybrid vehicles, a motor of a power generator or the like.

BRIEF DESCRIPTION OF THE DRAWING

FIG. 1 is a graph showing an influence of a compositional ratio of an oxide-based inclusion existing in a steel sheet upon a magnetic flux density $B_{50}$.

EMBODIMENTS FOR CARRYING OUT THE INVENTION

At first, the inventors have performed an experiment for examining an increase of a magnetic flux density through an improvement of a texture by using a steel slab of a chemical composition decreasing Mn and Al contents as far as possible and adding P and Sn and/or Sb with reference to the aforementioned conventional techniques, concretely a steel slab containing C: 0.0017 mass %, Si: 3.3 mass %, Mn: 0.03 mass %, P: 0.08 mass %, S: 0.0020 mass %, sol. Al: 0.0009 mass %, N: 0.0018 mass % and Sn: 0.03 mass %.

However, when the above steel slab is heated to 1100° C. and then hot-rolled to a thickness of 2.0 mm, troubles such as cracking or breakage due to brittleness are caused in a part of the slabs. In order to elucidate the cause of the breakage, the broken steel sheet is examined on the way of the hot rolling and hence it has been found that S is concentrated in a broken portion. Since concentration of Mn is not observed in the S-concentrated portion, the cause of the brittleness is guessed due to the fact that S in steel forms FeS having a low melting point during the hot rolling.

In order to prevent the brittleness due to the formation of FeS, it is enough to decrease S, but there is a limit in the decrease of S because desulfurization cost is increased. On the other hand, there is a method of suppressing the brittleness with S by adding Mn, but the addition of Mn becomes disadvantageous for the increase of the magnetic flux density.

Now, the inventors have considered that when S is fixed as CaS and precipitated by adding Ca, the formation of liquidus FeS can be prevented to suppress the brittleness in the hot rolling and made the following experiment.

When a steel slab comprising C: 0.0017 mass %, Si: 3.3 mass %, Mn: 0.03 mass %, P: 0.09 mass %, S: 0.0018 mass %, sol. Al: 0.0005 mass %, N: 0.0016 mass %, Sn: 0.03 mass % and Ca: 0.0030 mass % is reheated to a temperature of 1100° C. and hot-rolled to a thickness of 2.0 mm, cracking or breakage is not caused.

From the above, it is understood that the addition of Ca is effective for preventing the cracking or breakage in the hot rolling.

Then, the inventors have observed a section perpendicular to the rolling direction (C-section) in a hot rolled sheet produced by using the steel slab of the above chemical composition as a raw material and a product sheet (finishing-annealed sheet) with a scanning electron microscope (SEM) to analyze a chemical composition of oxide-based inclusions existing in the steel sheet and investigated a relation between the analyzed results and magnetic properties of the product sheet. As a result, it has been found that the magnetic properties are varied by the composition of the oxide-based inclusions existing in the steel sheet, particularly compositional ratio of CaO and compositional ratio of $Al_2O_3$.

In order to change the composition of the oxide-based inclusions in the above steel of the above chemical composition, the inventors have melted steels having variously changed addition amounts of Al and Ca used as a deoxidizing agent, concretely various steels having a chemical composition comprising C: 0.0010-0.0030 mass %, Si: 3.2-3.4 mass %, Mn: 0.03 mass %, P: 0.09 mass %, S: 0.0010-0.0030 mass %, sol. Al: 0.0001-0.00030 mass %, N: 0.0010-0.0030 mass %, Sn: 0.03 mass % and Ca: 0.0010-0.0040 mass %, which are continuously cast into a steel slab, respectively. Moreover, the reason why each of C, Si, S and N has the above range is due to variation in the melting, which is not intended.

Next, the steel slab is reheated to a temperature of 1100° C. and hot-rolled to obtain a hot rolled sheet of 2.0 mm in thickness, which is subjected to a hot band annealing at a soaking temperature of 1000*C, pickled, cold rolled to obtain a cold rolled sheet having a final thickness of 0.35 mm and thereafter subjected to finishing annealing at a temperature of 1000° C.

From the thus obtained steel sheet after the finishing annealing are cut out Epstein test specimens in a rolling direction (L) and a direction perpendicular to the rolling direction (C), respectively, and a magnetic flux density $B_{50}$ (magnetic flux density at a magnetization force of 5000 A/m) thereof is measured according to JIS C2552.

Also, a section of the finishing annealed steel sheet in the direction perpendicular to the rolling direction is observed with a scanning electron microscope (SEM) to analyze a composition of oxide-based inclusions, from which are determined a compositional ratio of CaO defined by the following equation (1):

$$CaO/(SiO_2+Al_2O_3+CaO) \quad (1)$$

and a compositional ratio of $Al_2O_3$ defined by the following equation (2):

$$Al_2O_3/(SiO_2+Al_2O_3+CaO) \quad (2).$$

Moreover, the compositional ratio of each of CaO and $Al_2O_3$ is an average value on 20 or more oxide-based inclusions.

In FIG. 1 is shown a relation among a magnetic flux density $B_{50}$ and a compositional ratio of CaO and a compositional ratio of $Al_2O_3$ in the oxide-based inclusions. As seen from this FIGURE, the magnetic flux density $B_{50}$ is poor when the compositional ratio of CaO or $CaO/(SiO_2+Al_2O_3+CaO)$ is less than 0.4 and the compositional ratio of $Al_2O_3$ or $Al_2O_3/(SiO_2+Al_2O_3+CaO)$ is less than 0.3, whereas the magnetic flux density $B_{50}$ is good in the finishing annealed steel sheets having $CaO/(SiO_2+Al_2O_3+CaO)$ of not less than 0.4 and/or $Al_2O_3/(SiO_2+Al_2O_3+CaO)$ of not less than 0.3.

With respect to the hot rolled sheets for the finishing annealed steel sheets indicating the poor magnetic flux density $B_{50}$, C-section is observed with the scanning electron microscope (SEM) to measure the compositional ratio of CaO and the compositional ratio of $Al_2O_3$ in the oxide-based inclusions, but the results are substantially the same as in the finishing annealed steel sheets.

With respect to the finishing annealed steel sheets indicating the poor magnetic flux density $B_{50}$, when the oxide-based inclusions at the section in the rolling direction are observed with an optical microscope, they have a form extending in the rolling direction.

The inventors have the following thought on the above results.

The oxide-based inclusions having a compositional ratio ($CaO/(SiO_2+Al_2O_3+CaO)$) of CaO of less than 0.4 and a compositional ratio ($Al_2O_3/(SiO_2+Al_2O_3+CaO)$) of $Al_2O_3$ of less than 0.3 have a tendency of extending in the rolling direction during the hot rolling because the melting point is low. The inclusions extended in the rolling direction are considered to block the grain growth in the hot band annealing and reduce the crystal grain size before the final cold rolling. In the finishing annealing, it is said that recrystallization nucleus with {111} orientation acting against the magnetic properties is caused from crystal grain boundary having a structure deformed by the cold rolling. However, since the grain size before the final cold rolling is reduced, the number of {111} orientations produced from the grain boundary is increased to promote the growth of {111} structure, and hence the magnetic flux density $B_{50}$ is considered to become poor.

The invention is developed based on the above new knowledge.

The reason of limiting the chemical composition in the non-oriented electrical steel sheet according to the invention will be described below.

C: Not More than 0.0050 Mass %

C is an element increasing the iron loss. Particularly, when it exceeds 0.0050 mass %, the increase of the iron loss becomes remarkable, so that the content is limited to not more than 0.0050 mass %. Preferably, it is not more than 0.0030 mass %. Moreover, the lower limit is not particularly restricted because the content is preferable to become smaller.

Si: More than 1.5 Mass % but not More than 5.0 Mass %

Si is generally added as a deoxidizing agent for steel. In the electrical steel sheet, it is an element effective for increasing an electric resistance to reduce the iron loss. In the invention, Si is particularly a main element for increasing the electric resistance because another element for increasing the electric resistance such as Al, Mn or the like is not added, so that it is positively added in an amount exceeding 1.5 mass %. However, when Si exceeds 5.0 mass %, cracking is caused during the cold rolling to lower the productivity and decrease the magnetic flux density, so that the upper limit is 5.0 mass %. Preferably, it is within a range of 3.0-4.5 mass %.

Mn: Not More than 0.10 Mass %

Mn is desirable to become smaller for increasing the magnetic flux density. Also, Mn is a harmful element because when MnS is formed with S and precipitated, not only the movement of magnetic domain walls is blocked but also the grain growth is blocked to deteriorate the magnetic properties. From such a viewpoint, Mn is limited to not more than 0.10 mass %. Preferably, it is not more than 0.08 mass %. Moreover, the lower limit is not particularly restricted because the content is preferable to become smaller.

P: More than 0.040 Mass % but not More than 0.2 Mass %

P has an effect of increasing the magnetic flux density and is added in an amount exceeding 0.040 mass % in the invention. However, the excessive addition of P brings about the decrease of the rolling property, so that the upper limit is 0.2 mass %. Preferably, it is within a range of 0.05-0.1 mass %.

S: Not More than 0.0050 Mass %

S forms precipitates or inclusions to deteriorate the magnetic properties of a product, so that the content is preferable to become smaller. In the invention, Ca is added to suppress a bad influence of S, so that the upper limit is accepted up to 0.0050 mass %. Also, it is preferable to be not more than 0.0025 mass % so as not to deteriorate the magnetic properties. Moreover, the lower limit is not particularly restricted because the S content is preferable to become smaller.

Sol. Al (Acid-Soluble Al): Not More than 0.0050 Mass %

Al is generally added as a deoxidizing agent for steel like Si. In the electrical steel sheet, it is an element effective for increasing an electric resistance to reduce the iron loss. However, Al is also an element of blocking the grain growth to decrease the magnetic flux density by forming and precipitating a nitride. In the invention, therefore, sol. Al (acid-soluble Al) is restricted to not more than 0.0050 mass % for increasing the magnetic flux density. Preferably, it is not more than 0.0010 mass %. Moreover, the lower limit is not particularly restricted because the content is preferable to become smaller.

N: Not More than 0.0040 Mass %

N deteriorates the magnetic properties like C and is limited to not more than 0.0040 mass %. Preferably, it is not more than 0.0030 mass %. Moreover, the lower limit is not particularly restricted because the content is preferable to become smaller.

Ca: 0.001-0.01 Mass %

Ca has an effect of fixing S in steel to prevent the formation of liquidus FeS to thereby improve the hot rolling property. In the invention, the addition of Ca is essential because Mn content is lower than that of the usual non-oriented electrical steel sheet. In the steel according to the invention having a low Mn content, Ca has an effect of fixing S and promoting the grain growth to increase the magnetic flux density. In order to obtain these effects, the addition of not less than 0.001 mass % is necessary. On the other hand, when it is added in an amount exceeding 0.01 mass %, a sulfide or an oxide of Ca is increased to block the grain growth and decrease the magnetic flux density, so that the upper limit is necessary to be 0.01 mass %. Preferably, it is within a range of 0.002-0.004 mass %.

In the non-oriented electrical steel sheet according to the invention, it is preferable to add Sn and Sb within the following range in addition to the above essential chemical composition.

Sn, Sb: 0.01-0.1 Mass %

Sn and Sb have an effect of improving the texture to enhance the magnetic properties. In order to obtain such an effect, even when they are added alone or in combination, each of them is preferable to be not less than 0.01 mass %. On the other hand, when they are added excessively, steel is embrittled to cause surface defects such as sheet breakage, scab and the like on the way of the production process, so that each of them is preferable to be not more than 0.1 mass % in case of either the single addition or the composite addition. Preferably, each of them is within a range of 0.02-0.05 mass %.

In the non-oriented electrical steel sheet according to the invention, the remainder other than the above ingredients is Fe and inevitable impurities. However, other elements can be included within the scope not damaging the effect of the invention.

The composition of the inclusions existing in the non-oriented electrical steel sheet according to the invention will be described below.

In order that the non-oriented electrical steel sheet according to the invention has excellent magnetic properties, it is necessary that a compositional ratio ($CaO/(SiO_2+Al_2O_3+CaO)$) of CaO is not less than 0.4 and a compositional ratio ($Al_2O_3/(SiO_2+Al_2O_3+CaO)$) of $Al_2O_3$ is not less than 0.3 in the oxide-based inclusions existing in the product sheet (finishing annealed steel sheet) and the hot rolled steel sheet used as a raw material therefor. When the compositional ratio is outside the above range, the oxide-based inclusion is extended by rolling, which blocks the grain growth in the hot band annealing to deteriorate the magnetic properties. Preferably, the compositional ratio of CaO is not less than 0.5 and/or the compositional ratio of $Al_2O_3$ is not less than 0.4.

Moreover, each of the compositional ratio of CaO and the compositional ratio of $Al_2O_3$ in the oxide-based inclusions existing in the steel sheet is an average value calculated from values obtained when the section of the steel sheet perpendicular to the rolling direction is observed with SEM (scanning electron microscope) to analyze chemical compositions of 20 or more oxide-based inclusions.

Next, there will be described a method of controlling the composition of the inclusions existing in the non-oriented electrical steel sheet according to the invention to the above proper range.

In order to control the composition of the inclusions, particularly the compositional ratio of CaO and the compositional ratio of $Al_2O_3$ to the above proper range, it is necessary to rationalize an addition amount of Si or Al as a deoxidizing agent in a secondary refining step, an addition amount of Ca, a deoxidizing time and so on.

Concretely, an addition amount of $Al_2O_3$ as a deoxidizing agent is increased for enhancing the compositional ratio of $Al_2O_3$. However, as the addition amount of Al is increased, sol. Al is also increased, so that the addition amount of Al is increased to such a range that sol. Al is not more than 0.0050 mass %. On the other hand, in order to enhance the compositional ratio of CaO, Ca source such as CaSi or the like is added. Thus, the compositional ratio of the oxide-based inclusion exiting in steel can be controlled to the above range. Moreover, Al is a nitride forming element and Ca is a sulfide forming element, so that it is also important that the addition amounts of Al as a deoxidizing agent and the Ca source are adjusted so as to attain the above compositional ratios of CaO and $Al_2O_3$ in accordance with the N and S contents.

There will be described the production method of the non-oriented electrical steel sheet according to the invention below.

The non-oriented electrical steel sheet according to the invention can be produced with production facilities applied to the ordinary non-oriented electrical steel sheets and by the ordinary production process. In the production method of the non-oriented electrical steel sheet according to the invention, steel melted in a converter, an electric furnace or the like is first adjusted to a given chemical composition by secondary-refining with a degassing equipment or the like and then shaped into a raw steel material (slab) by a continuous casting method or an ingot making-blooming method.

In the production method of the invention, it is most important to control the composition of the oxide-based inclusions existing in steel to the proper range as previously mentioned. That is, it is necessary to control a compositional ratio ($CaO/(SiO_2+Al_2O_3+CaO)$) of CaO to not less than 0.4 and/or a compositional ratio ($Al_2O_3/(SiO_2+Al_2O_3+CaO)$) of $Al_2O_3$ to not less than 0.3. This method is mentioned above.

Thereafter, the thus obtained steel slab is subjected to hot rolling, hot band annealing, pickling, cold rolling, finishing annealing and further coating and baking of an insulating film to obtain a non-oriented electrical steel sheet (product sheet). In this case, production conditions of each step may be the same as in the production of the ordinary non-oriented electrical steel sheet, but are preferable to be the following ranges.

At first, a temperature of reheating the slab (SRT) in the hot rolling is preferable to be a range of 1000-1200° C. When SRT exceeds 1200° C., not only the energy loss is uneconomically increased, but also the strength of the slab at a high temperature is decreased to easily cause production troubles such as slab sagging and the like. While when it is lower than 1000° C., it is difficult to perform the hot rolling and it becomes unfavorable.

Further, the hot rolling may be carried out under ordinary conditions, but the thickness of the steel sheet after the hot rolling is preferably within a range of 1.5-2.8 mm in view of ensuring the productivity. More preferably, it is a range of 1.7-2.3 mm.

The hot band annealing is preferable to be performed at a soaking temperature of 900-1150° C. When the soaking temperature is lower than 900° C., the rolled structure is retained, so that the effect of improving the magnetic properties is not obtained sufficiently. While when it exceeds 1150° C., the crystal grains are coarsened and hence cracking is easily caused in the cold rolling and becomes uneconomical.

Next, the steel sheet after the hot band annealing is subjected to a single cold rolling or two or more cold rollings including an intermediate annealing therebetween to thereby obtain a cold rolled steel sheet having a final thickness. In this case, it is preferable to adopt a rolling performed by raising a sheet temperature to about 200° C. or a so-called warm rolling in order to enhance the magnetic flux density.

Moreover, the thickness of the cold rolled sheet (final thickness) is not particularly limited, but is preferable to be a range of 0.10-0.50 mm. In order to obtain an effect of reducing the iron loss, it is more preferable to be a range of 0.10-0.30 mm.

Subsequently, the steel sheet after the cold rolling (cold rolled sheet) is subjected to finishing annealing. In the finishing annealing, a soaking temperature is preferable to be a range of 700-1150° C. When the soaking temperature is lower than 700° C., the recrystallization is not promoted sufficiently and the magnetic properties are largely deteriorated and further the effect of correcting the sheet form in the continuous annealing is not obtained sufficiently. While when it exceeds 1150° C., the crystal grains are coarsened to increase the iron loss at a high frequency zone.

In the steel sheet after the finishing annealing, it is preferable that an insulating film is applied to the steel sheet surface and baked for more reducing the iron loss. Moreover, it is preferable that the insulating film is a resin-containing organic coating when it is intended to ensure a good punchability or a semi-organic or an inorganic coating when a weldability is considered to be important.

Example 1

Steels A-Q having different chemical compositions shown in Table 1 are melted and continuously cast into steel slabs. In the melting of the steel, Si is used as a deoxidizing agent, but Al is used as a deoxidizing agent in addition to Si in case of the steel B. Also, CaSi is used as a Ca source. The amount of the deoxidizing agent or CaSi is adjusted in accordance with the N or S content in steel.

Next, the steel slab is reheated to a temperature of 1050-1130° C., hot-rolled to obtain a hot rolled steel sheet of 2.0 mm in thickness, which is subjected to a hot band annealing at a soaking temperature of 1000° C. in continuous annealing, cold-rolled to obtain a cold rolled steel sheet having a final thickness of 0.35 mm, subjected to finishing annealing at a soaking temperature of 1000° C. and coated with an insulating film to obtain a non-oriented electrical steel sheet (product sheet). In the steels E and Q shown in Table 1, cracking is caused during cold rolling, so that subsequent steps are stopped.

TABLE 1

| Steel | Chemical composition (mass %) | | | | | | | | | |
|---|---|---|---|---|---|---|---|---|---|---|
| symbol | C | Si | Mn | P | S | sol. Al | N | Sn | Sb | Ca |
| A | 0.0017 | 3.36 | 0.024 | 0.08 | 0.0016 | 0.0008 | 0.0017 | 0.038 | — | 0.0032 |
| B | 0.0019 | 3.38 | 0.025 | 0.07 | 0.0016 | 0.0015 | 0.0016 | 0.039 | — | 0.0017 |
| C | 0.0018 | 3.37 | 0.024 | 0.08 | 0.0018 | 0.0005 | 0.0019 | 0.039 | — | 0.0018 |
| D | 0.0016 | 3.29 | 0.024 | 0.07 | 0.0017 | 0.0007 | 0.0018 | — | 0.028 | 0.0028 |
| E | 0.0017 | 5.15 | 0.032 | 0.07 | 0.0020 | 0.0009 | 0.0018 | 0.037 | — | 0.0032 |
| F | 0.0019 | 3.93 | 0.031 | 0.08 | 0.0018 | 0.0003 | 0.0021 | 0.028 | — | 0.0034 |
| G | 0.0014 | 1.85 | 0.029 | 0.08 | 0.0015 | 0.0015 | 0.0022 | 0.028 | — | 0.0036 |
| H | 0.0018 | 1.40 | 0.028 | 0.07 | 0.0019 | 0.0018 | 0.0016 | 0.029 | — | 0.0036 |
| I | 0.0021 | 3.21 | 0.057 | 0.12 | 0.0022 | 0.0008 | 0.0033 | 0.027 | 0.015 | 0.0035 |
| J | 0.0020 | 3.31 | 0.128 | 0.08 | 0.0022 | 0.0009 | 0.0020 | 0.031 | 0.025 | 0.0027 |
| K | 0.0018 | 3.28 | 0.046 | 0.08 | 0.0020 | 0.0001 | 0.0022 | 0.050 | — | 0.0028 |
| L | 0.0019 | 3.31 | 0.035 | 0.09 | 0.0024 | 0.0052 | 0.0029 | 0.044 | — | 0.0029 |
| M | 0.0021 | 3.27 | 0.036 | 0.14 | 0.0057 | 0.0015 | 0.0021 | — | 0.030 | 0.0027 |
| N | 0.0017 | 3.33 | 0.028 | 0.03 | 0.0017 | 0.0024 | 0.0017 | 0.037 | — | 0.0028 |
| O | 0.0019 | 3.30 | 0.022 | 0.05 | 0.0016 | 0.0011 | 0.0025 | 0.035 | — | 0.0031 |
| P | 0.0020 | 3.30 | 0.028 | 0.16 | 0.0018 | 0.0003 | 0.0019 | 0.036 | — | 0.0029 |
| Q | 0.0018 | 3.28 | 0.038 | 0.22 | 0.0022 | 0.0031 | 0.0018 | 0.035 | — | 0.0034 |

| | Compositional ratio of oxide-based inclusion | | | | Magnetic properties of product sheet | | |
|---|---|---|---|---|---|---|---|
| | $CaO/(SiO_2 + Al_2O_3 + CaO)$ | | $Al_2O_3/(SiO_2 + Al_2O_3 + CaO)$ | | | | |
| Steel symbol | Hot rolled steel sheet | Product sheet | Hot rolled steel sheet | Product sheet | Iron loss $W_{15/50}$ (W/kg) | Magnetic flux density $B_{50}$ (T) | Remarks |
| A | 0.5 | 0.5 | 0.1 | 0.1 | 1.98 | 1.712 | Example |
| B | 0.3 | 0.3 | 0.4 | 0.4 | 2.01 | 1.711 | Example |
| C | 0.3 | 0.3 | 0.2 | 0.2 | 2.15 | 1.693 | Comparative Example |
| D | 0.4 | 0.5 | 0.2 | 0.1 | 2.02 | 1.710 | Example |
| E | Cracking is caused during cold rolling | | | | — | — | Comparative Example |
| F | 0.5 | 0.4 | 0.1 | 0.1 | 1.88 | 1.701 | Example |
| G | 0.5 | 0.5 | 0.3 | 0.2 | 2.45 | 1.749 | Example |
| H | 0.6 | 0.7 | 0.3 | 0.3 | 2.61 | 1.758 | Comparative Example |
| I | 0.5 | 0.5 | 0.2 | 0.2 | 1.96 | 1.715 | Example |
| J | 0.4 | 0.4 | 0.2 | 0.2 | 2.12 | 1.694 | Comparative Example |
| K | 0.5 | 0.5 | 0.1 | 0.1 | 1.97 | 1.715 | Example |
| L | 0.5 | 0.5 | 0.5 | 0.5 | 2.19 | 1.691 | Comparative Example |

TABLE 1-continued

| | | | | | | | |
|---|---|---|---|---|---|---|---|
| M | 0.4 | 0.4 | 0.4 | 0.4 | 2.21 | 1.690 | Comparative Example |
| N | 0.5 | 0.5 | 0.3 | 0.3 | 2.16 | 1.694 | Comparative Example |
| O | 0.5 | 0.5 | 0.2 | 0.2 | 2.08 | 1.702 | Example |
| P | 0.5 | 0.5 | 0.1 | 0.1 | 1.94 | 1.719 | Example |
| Q | Cracking is caused during cold rolling | | | | — | — | Comparative Example |

Then, sections of the hot rolled sheet and the steel sheet after the finishing annealing perpendicular to the rolling direction are observed by a scanning electron microscope (SEM) to analyze a chemical composition in 30 oxide-based inclusions and determine an average value thereof, from which a compositional ratio of CaO and a compositional ratio of $Al_2O_3$ are calculated.

Also, Epstein test specimens are cut out from the product sheet in the rolling direction (L) and the direction perpendicular to the rolling direction (C), respectively, and the magnetic flux density $B_{50}$ (magnetic flux density at a magnetization force of 5000 A/m) and iron loss $W_{15/50}$ (iron loss in excitation at a magnetic flux density of 1.5 T and a frequency of 50 Hz) are measured according to JIS C2552.

The above measured results are also shown in Table 1. As seen from these results, the steel sheets adapted to the invention can prevent the breakage in the rolling and maintain a high magnetic flux density that the magnetic flux density $B_{50}$ is not less than 1.70 T, and have excellent magnetic properties.

Example 2

Steels R-U having different chemical compositions shown in Table 2 are melted and continuously cast into steel slabs. In the melting of the steel. Si is used as a deoxidizing agent, but Al is used as a deoxidizing agent in addition to Si in case of the steel S. Also, CaSi is used as a Ca source. The amount of the deoxidizing agent or CaSi is adjusted in accordance with the N or S content in steel.

Next, the steel slab is reheated to a temperature of 1050-1110° C., hot-rolled to obtain a hot rolled steel sheet of 1.6 mm in thickness, which is subjected to a hot band annealing at a soaking temperature of 1000° C. in continuous annealing, cold-rolled to obtain a cold rolled steel sheet having a final thickness of 0.15 mm, subjected to finishing annealing at a soaking temperature of 1000° C. and coated with an insulating film to obtain a non-oriented electrical steel sheet (product sheet).

TABLE 2

| Steel symbol | Chemical composition (mass %) | | | | | | | | | |
|---|---|---|---|---|---|---|---|---|---|---|
| | C | Si | Mn | P | S | sol. Al | N | Sn | Sb | Ca |
| R | 0.0017 | 3.36 | 0.024 | 0.08 | 0.0016 | 0.0008 | 0.0017 | 0.038 | — | 0.0032 |
| S | 0.0019 | 3.38 | 0.025 | 0.07 | 0.0016 | 0.0015 | 0.0016 | 0.039 | — | 0.0017 |
| T | 0.0018 | 3.37 | 0.024 | 0.08 | 0.0018 | 0.0005 | 0.0019 | 0.039 | — | 0.0018 |
| U | 0.0017 | 3.37 | 0.025 | 0.01 | 0.0017 | 0.0006 | 0.0017 | 0.039 | — | 0.0001 |

| Steel symbol | Compositional ratio of oxide-based inclusion: $CaO/(SiO_2 + Al_2O_3 + CaO)$ | | $Al_2O_3/(SiO_2 + Al_2O_3 + CaO)$ | | Magnetic properties of product sheet | | Remarks |
|---|---|---|---|---|---|---|---|
| | Hot rolled steel sheet | Product sheet | Hot rolled steel sheet | Product sheet | Iron loss $W_{10/800}$ (W/kg) | Magnetic flux density $B_{50}$ (T) | |
| R | 0.5 | 0.5 | 0.1 | 0.1 | 24.7 | 1.692 | Example |
| S | 0.3 | 0.3 | 0.4 | 0.4 | 24.8 | 1.691 | Example |
| T | 0.3 | 0.3 | 0.2 | 0.2 | 26.1 | 1.673 | Comparative Example |
| U | 0.0 | 0.0 | 0.2 | 0.2 | 27.8 | 1.654 | Comparative Example |

Then, sections of the hot rolled sheet and the steel sheet after the finishing annealing perpendicular to the rolling direction are observed by a scanning electron microscope (SEM) to analyze a chemical composition in 30 oxide-based inclusions and determine an average value thereof, from which a compositional ratio of CaO and a compositional ratio of $Al_2O_3$ are calculated.

Also, Epstein test specimens are cut out from the product sheet in the rolling direction (L) and the direction perpendicular to the rolling direction (C), respectively, and the magnetic flux density $B_{50}$ (magnetic flux density at a magnetization force of 5000 A/m) and iron loss $W_{10/800}$ (iron loss in excitation at a magnetic flux density of 1.0 T and a frequency of 800 Hz) are measured according to JIS C2552.

The above measured results are also shown in Table 2. As seen from these results, the steel sheets adapted to the invention can prevent the breakage in the rolling and reduce the iron loss $W_{10/800}$ to not more than 25 W/kg while maintaining a high magnetic flux density that the magnetic flux density $B_{50}$ is not less than 1.69 T, and have excellent magnetic properties at not only a commercial frequency but also a high frequency zone.

INDUSTRIAL APPLICABILITY

According to the invention, material having a high magnetic flux density can be produced cheaply in a good productivity and have an effect of reducing a copper loss of a motor, so that they can be advantageously applied to an iron core for an induction motor having a tendency of increasing the copper loss as compared with the iron loss.

The invention claimed is:

1. A non-oriented electrical steel sheet having a chemical composition consisting of C: not more than 0.0050 mass %, Si: more than 1.5 mass % but not more than 5.0 mass %, Mn: not more than 0.10 mass %, sol. Al: 0.0001 mass % to not more than 0.0050 mass %, P: more than 0.040 mass % but not more than 0.2 mass %, S: not more than 0.0050 mass %, N: not more than 0.0040 mass %, Ca: 0.001-0.01 mass %, optionally Sn: 0.01 mass % to not more than 0.1 mass %, optionally Sb: 0.01 mass % to not more than 0.1 mass %, and the remainder being Fe and inevitable impurities, wherein, in oxide based inclusions in a finished form of the steel sheet, a mass % ratio as defined by equation (1) is not less than 0.4, and/or a mass % ratio as defined by equation (2) is not less than 0.3, $$CaO/(SiO_2+Al_2O_3+CaO) \quad (1),$$

$$Al_2O_3/(SiO_2+Al_2O_3+CaO) \quad (2).$$

2. A hot rolled steel sheet used as a raw material for the non-oriented electrical steel sheet of claim 1, the hot rolled steel sheet having a chemical composition consisting of C: not more than 0.0050 mass %, Si: more than 1.5 mass % but not more than 5.0 mass %, Mn: not more than 0.10 mass %, sol. Al: 0.0001 mass % to not more than 0.0050 mass %, P: more than 0.040 mass % but not more than 0.2 mass %, S: not more than 0.0050 mass %, N: not more than 0.0040 mass %, Ca: 0.001-0.01 mass %, optionally Sn: 0.01 mass % to not more than 0.1 mass %, optionally Sb: 0.01 mass % to not more than 0.1 mass %, and the remainder being Fe and inevitable impurities, wherein, in oxide based inclusions in the hot rolled steel sheet, a mass % ratio as defined by equation (1) is not less than 0.4, and/or a mass % ratio as defined by equation (2) is not less than 0.3, $$CaO/(SiO_2+Al_2O_3+CaO) \quad (1),$$

$$Al_2O_3/(SiO_2+Al_2O_3+CaO) \quad (2).$$

3. The non-oriented electrical steel sheet according to claim 1, wherein the steel sheet has a magnetic flux density ($B_{50}$) that is not less than 1.69 T.

4. The non-oriented electrical steel sheet according to claim 1, wherein the steel sheet has a magnetic flux density ($B_{50}$) that is not less than 1.70 T.

* * * * *